United States Patent [19]

Billings

[11] Patent Number: 4,512,090

[45] Date of Patent: Apr. 23, 1985

[54] EXCAVATOR BUCKET WITH RETRACTABLE SCRAPER AND SCARIFIER

[76] Inventor: Jeff Billings, Rte. #2, Box 4035, Shepherd, Tex. 77371

[21] Appl. No.: 555,122

[22] Filed: Nov. 25, 1983

[51] Int. Cl.[3] ..... E02F 3/76

[52] U.S. Cl. ..... 37/117.5; 172/249; 172/662; 172/777; 414/724; 414/912; 37/DIG. 3

[58] Field of Search ..... 37/117.5, DIG. 3, DIG. 12; 172/777, 784, 659, 766, 662, 438, 778, 136, 197, 140, 133, 249; 414/724, 723, 712

[56] References Cited

U.S. PATENT DOCUMENTS

| | | | |
|---|---|---|---|
| 1,407,486 | 2/1922 | Sandberg | 37/118 A |
| 3,034,238 | 5/1962 | McGee | 172/777 |
| 3,478,449 | 11/1969 | Baker | 37/117.5 |
| 4,189,854 | 2/1980 | Haynes | 37/117.5 |

FOREIGN PATENT DOCUMENTS

| | | | |
|---|---|---|---|
| 2083110 | 3/1982 | United Kingdom | 37/DIG. 3 |

*Primary Examiner*—Edgar S. Burr
*Assistant Examiner*—Moshe I. Cohen
*Attorney, Agent, or Firm*—Neal J. Mosely

[57] ABSTRACT

A backhoe is provided with a retractable scraper and scarifier. The backhoe excavator bucket includes a stationary first mounting plate and a second plate pivotally mounted thereon for rotational movement with respect thereto and which carries a scarifier assembly. The scarifier assembly is movable in a plane parallel to the second plate. The second plate is provided with a lower rearwardly curved cutting edge or scraper portion containing slots through which the scarifier teeth may be extended or retracted. Rotational movement of the second plate with respect to the first and movement of the scarifier assembly with respect to the second plate is accomplished by hydraulic or pneumatic cylinders controlled by the operator of the prime mover.

14 Claims, 4 Drawing Figures

EXCAVATOR BUCKET WITH RETRACTABLE SCRAPER AND SCARIFIER

BACKGROUND OF THE INVENTION

1. Field of the Invention

This invention relates generally to construction equipment, such as backhoes, and more particularly to a backhoe having a retractable scarifier and scraper.

2. Brief Description of the Prior Art

Excavator buckets used on earth moving equipment such as bulldozers, tractors, and backhoes are normally mounted on boom arms or dippersticks to pivot in a forward and backward motion for scooping and dumping operations. The buckets are also used for scraping, grading, and for chopping or breaking up compacted substrate.

Various devices have been attached to the bucket to facilitate the above mentioned operations. Cutting and scraping blades have been attached to the leading and trailing edges of the bucket for scraping, grading, and chopping operations. Most of these attachments are not ideally suited for grading or shaping inclines because they are welded or otherwise rigidly affixed to the bucket which is positioned by the boom or dipperstick and do not move relative thereto in contrast to the present invention.

Ripper and teeth assemblies have been added to the rear of the bucket to assist in dislodging and earth breaking operations. Most attachments of this type are also rigidly affixed to the bucket or they are pinned in such a manner that the operator must manually remove the structure when no ripping operation is desired. Such non movable teeth or ripping attachments are also undesirable because they are always at their fully extended position and constantly need to be repositioned by the boom or dipperstick to maintain the proper depth of penetration.

There are several patents which disclose excavator buckets having cutting edges and scarifier devices.

Hipp, U.S. Pat. No. 2,774,155 discloses a combined scraper, bulldozer, and scarifier.

Fryrear, U.S. Pat. No. 4,041,624 discloses an excavator bucket having integral ripper shanks.

Rogers, U.S. Pat. No. 4,329,794 discloses a dragline bucket having ripping teeth.

Etzler, U.S. Pat. No. 4,056,205 discloses a loader having tines attached thereto.

Arnold, U.S. Pat. No. 4,279,085 discloses an excavator bucket having scraping teeth along the backside.

Vos, U.S. Pat. No. 3,109,248 discloses a grader bucket having a stationary cutting blade constructed for scraping on either forward or backward movement.

Bolten, U.S. Pat. No. 3,912,092 discloses a lift bucket having a stationary rear scraper.

Cobb, U.S. Pat. No. 3,922,017 discloses a multiple chisel arrangement for use in conjunction with excavators.

Roe, U.S. Pat. No. 4,023,288 discloses a combination compaction roller with a back hoe.

The prior art in general, and none of these patents in particular, disclose the present invention of an excavator bucket having a pivotally mounted scraper which is rotationally movable with respect to the bucket and which carries a vertically movable scarifier assembly. Additionally, none suggest providing rotational and vertical movement by hydraulic or pneumatic means controlled by the operator of the prime mover.

SUMMARY OF THE INVENTION

It is therefore an object of the present invention to provide an improved multiple purpose excavator bucket.

Another object of this invention is to provide a multipurpose excavator bucket to be operated by conventional earth moving vehicles.

Another object of this invention is to provide a multipurpose excavator bucket to maximize the effectiveness of back cutting, grading, leveling, and earth breaking operations.

Another object of this invention is to provide a multipurpose excavator bucket having parts which are easily replaced as they become worn or damaged.

Other objects of the invention will become apparent from time to time throughout the specification and claims as hereinafter related.

The above noted objects and other objects of the invention are accomplished by an excavator bucket having a first mounting plate and a second plate pivotally mounted thereon for rotational movement with respect thereto. The second plate carries a vertically movable scarifier assembly and is provided with a lower curved scraper portion. Rotational movement of the second plate with respect to the first and movement of the scarifier assembly with respect to the second plate is accomplished by hydraulic or pneumatic cylinders controlled by the operator of the prime mover.

DESCRIPTION OF THE PREFERRED EMBODIMENT

Figure 1:
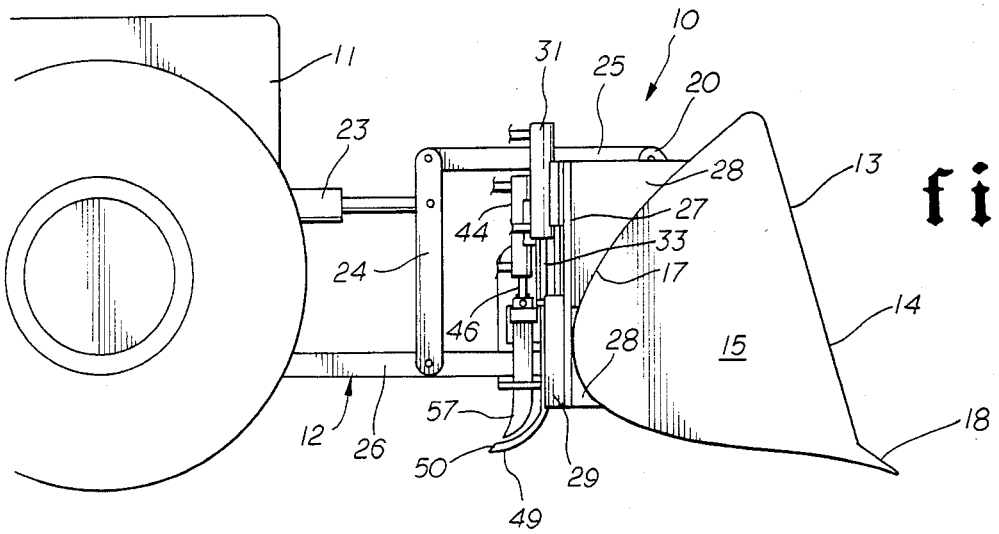
FIG. 1 is a view in side elevation of the excavator bucket in accordance with the present invention.
Figure 2:
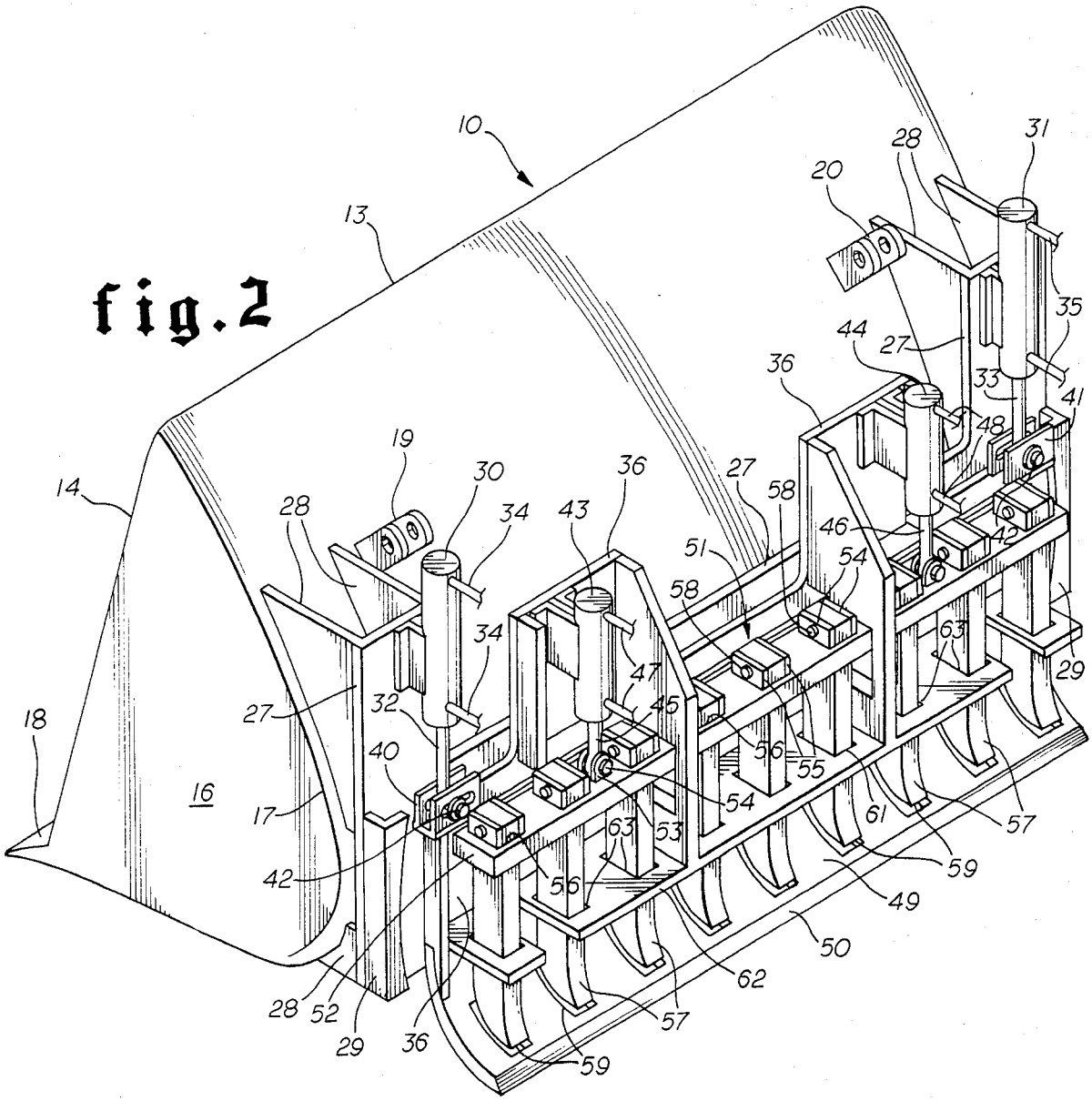
FIG. 2 is an isometric view of the back of the excavator bucket.
Figure 3:
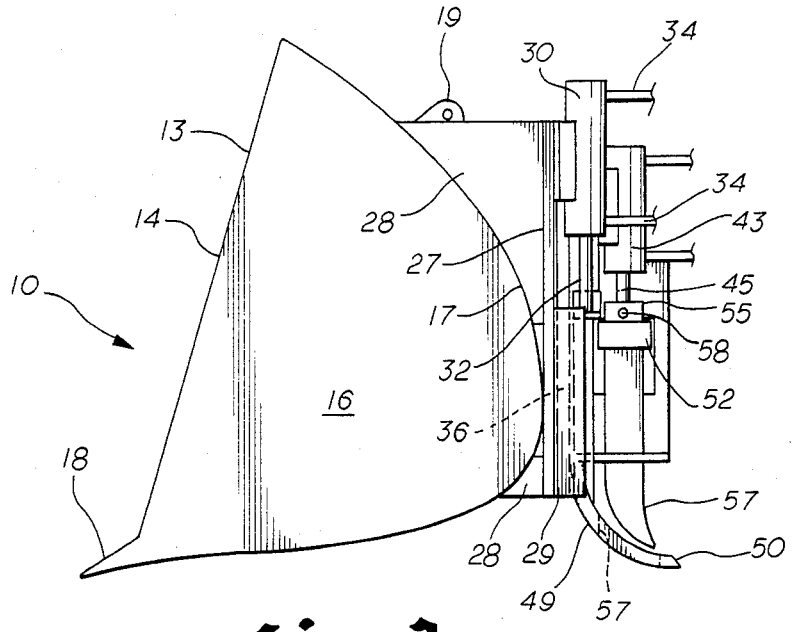
FIG. 3 is a view in side elevation of the opposite side of the excavator bucket.

Referring to the drawings by numerals of reference, there is shown a preferred excavator bucket apparatus 10 connected to a prime mover 11 by a boom assembly 12. The excavator bucket 13 has an open front end 14 adapted for scooping operations, side walls 15 and 16, and a curved outwardly convex rear wall 17. A leading or scooping edge 18 which extends between the side walls 15 and 16 extends outwardly from the bottom of the bucket 13.

Ears 19 and 20 are provided on the upper portion and ears 21 and 22 on the lower portion of the rear wall 17 for attachment of the bucket 13 to the boom assembly 12. Boom assembly 12 is of conventional construction and comprises an operating cylinder 23 connected to a pivot arm 24 which operates linkage 25 attached to the ears 19 and 20. A lower linkage 26 attached to the ears 21 and 22 connects the bucket 13 to the prime mover 11.

A flat mounting plate 27 is welded tangentially to the rear wall 17 and reinforced by gussets 28. Plate 27 extends the width of the bucket 13 and generally "L" shaped guide brackets 29 are provided at each end. A pair of cylinders 30 and 31 are mounted on the upper portion of the plate 27 near each end with their piston rods 32 and 33 directed downwardly. Hose connections 34 and 35 extend to the prime mover 11 for operation of the cylinders 30 and 31.

Figure 4:
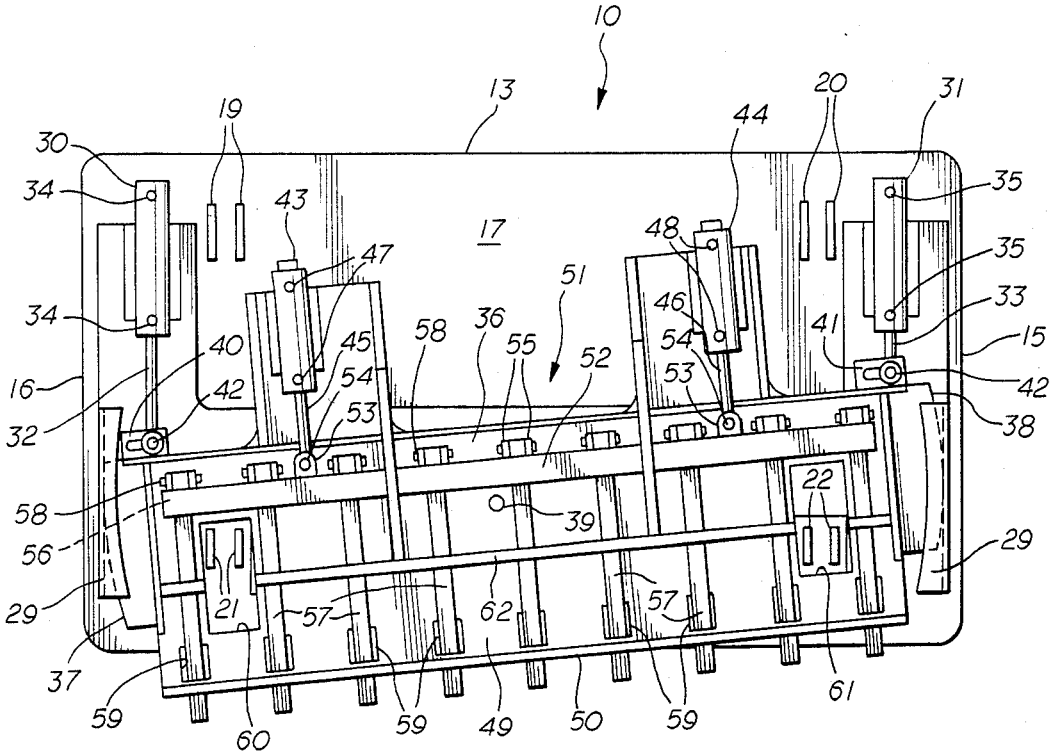
FIG. 4 is a view in rear elevation of the excavator bucket shown in one operative position.

A second flat plate 36 having arcuate ends 37 and 38 which are slidably received within the guide brackets 29 is center-pinned to the plate 27 by means of a pivot pin 39 (FIG. 4). Brackets 40 and 41 on the upper portion of the plate 36 near the ends 37 and 38 pivotally connect the lower ends of piston rods 32 and 33 by pins 42. A pair of cylinders 43 and 44 are mounted on the upper portion of the plate 36 with their piston rods 45 and 46 directed downwardly. Hose connections 47 and 48 extend to the prime mover 11 for operation of the cylinders 43 and 44.

A curved back cutting edge 49 is welded to the lower portion of the plate 36 and extends outwardly therefrom to terminate in a sharpened blade portion 50. The back cutting edge 49 allows the bucket to be used for cutting or scraping the earth with either a forward or backward movement.

A comb-like rake or scarifier assembly 51 is operatively attached to the piston rods 45 and 46 to move vertically in a plane parallel to the plate 36. The scarifier assembly 51 comprises a slotted rectangular horizontal guide member 52 provided with bifurcated lugs or ears 53 near each end to receive the lower ends of piston rods 45 and 46 and are pinned thereto by pins 54. A series of lugs 55 on the upper surface of guide member 52 adjacent the slots 56 releasably attach the scarifier teeth 57 by means of pins 58. The teeth 57 are formed of hardened steel shaped in a generally "J" configuration with a pointed lower curved portion having a substantially similar radius of curvature to the back cutting edge 49.

The back cutting edge 49 is provided with a series of slots 59 which guide the teeth 57 for retraction and extension therethrough for earth breaking and dislodging operations. Openings 60 and 61 are provided in the plate 36 to allow connection of the linkage 26 to the ears 21 and 22 on the bucket 13 (FIG. 4). The openings 60 and 61 are of sufficient size and shape to permit rotary movement of the plate 36 without touching the linkage 26. A horizontal guide plate 62 projects outwardly from plate 36 and is provided with slots 63 in vertical alignment with the slots 59 to guide the teeth 57. When the teeth 57 are in the extended operational position, the back cutting edge 49 and the guide plate 62 provide reinforcement and support along the shank portion of the teeth 57.

OPERATION

The excavator bucket apparatus 10 is controlled by the operator of the prime mover to assume a variety of operational positions. Actuation of the operating cylinder 23 allows the bucket 13 to pivot about the connection of the lower linkage 26 for scooping and dumping operations.

Actuation of the cylinders 30 and 31 causes the plate 36 and back cutting edge 49 to rotate relative to the bucket 13. Either side may be raised or lowered to extend below the bottom of the bucket 13 for grading and leveling operations as well as scraping or cutting operations in a forward or backward movement.

Actuation of the cylinders 43 and 44 extend the scarifier teeth 57 through the cutting edge 49. When extended beyond the cutting edge 49, the teeth 57 are used in earth breaking and dislodging operations. The cylinders 43 and 44 may also operate the scarifier teeth 57 in a chopping motion. As the teeth 57 become worn or damaged, they may be easily removed and replaced individually by removing the pins 58 and sliding them out of the appropriate slots.

It should be obvious to those skilled in the art that the apparatus is adaptable to various earth moving vehicles, and the cylinders herein described may be either hydraulically or pneumatically operated depending upon the particular system utilized by the vehicle.

While this invention has been described fully and completely with special emphasis upon a preferred embodiment, it should be understood that within the scope of the appended claims the invention may be practiced otherwise than as specifically described herein.

I claim:

1. An excavator bucket for attachment to earth moving vehicles comprising
   - a bucket having spaced parallel side walls, an open front, and a curved, outwardly convex rear wall having a cutting edge at said open front,
   - a curved, rearwardly facing scraper member mounted on said bucket rear wall for pivotal movement relative thereto,
   - a retractable scarifier assembly carried by said scraper member and vertically movable relative thereto, and
   - means for controlling vertical movement of said scarifier assembly.

2. An excavator bucket according to claim 1 in which said scarifier assembly comprises a horizontal cross-member having a plurality of teeth individually attached to and depending downwardly therefrom, and
   - means supported on said bucket rear wall guiding said scarifier teeth for vertical movement.

3. An excavator bucket according to claim 2 in which said teeth have a curved lower portion and are positioned for backing against said scraper member.

4. An excavator bucket according to claim 1 including
   - means for controlling pivotal movement of said scraper member.

5. An excavator bucket according to claim 4 in which said means for moving said scarafier assembly and for moving said scraper member each being fluid actuated means.

6. An excavator bucket according to claim 5 in which said fluid actuated means comprises hydraulic cylinders.

7. An excavator bucket according to claim 5 in which said fluid actuated means comprises a pneumatic cylinder.

8. An excavator bucket according to claim 1 in which said bucket has a first stationary plate secured to said rear wall,
   - a second plate pivotally mounted on said first plate for rotational movement with respect thereto, and
   - said scarifier assembly being carried by said second plate and vertically movable with respect thereto.

9. An excavator bucket according to claim 8 including
   - means for controlling rotational movement of said second plate, and
   - means on said second plate for controlling vertical movement of said scarifier assembly thereon.

10. An excavator bucket according to claim 8 in which
   - said second plate has a cutting edge portion curved outwardly therefrom.

11. An excavator bucket according to claim 10 in which said cutting edge portion is provided with a plurality of slots to slidably receive scarifier teeth.

12. An excavator bucket according to claim 11 in which said scarifier assembly comprises a horizontal cross-member having a plurality of teeth individually releasably attached thereto and depending downwardly therefrom and movable vertically through said cutting edge slots.

13. An excavator bucket according to claim 12 in which said means for controlling rotational movement and said means for controlling vertical movement are hydraulic cylinders.

14. An excavator bucket according to claim 12 in which said means for controlling rotational movement and said means for controlling vertical movement are pneumatic cylinders.

* * * * *